US011311123B2

(12) United States Patent
Morden

(10) Patent No.: US 11,311,123 B2
(45) Date of Patent: Apr. 26, 2022

(54) ANTI-WRINKLE/ANTI-SNORING/THERAPEUTIC FOAM PILLOW

(71) Applicant: Shauna Morden, London (GB)

(72) Inventor: Shauna Morden, London (GB)

( * ) Notice: Subject to any disclaimer, the term of this patent is extended or adjusted under 35 U.S.C. 154(b) by 88 days.

(21) Appl. No.: 15/953,415

(22) Filed: Apr. 14, 2018

(65) Prior Publication Data

US 2019/0313817 A1 Oct. 17, 2019

(51) Int. Cl.
*A47G 9/10* (2006.01)

(52) U.S. Cl.
CPC ..... *A47G 9/1054* (2013.01); *A47G 9/109* (2013.01); *A47G 2009/1018* (2013.01)

(58) Field of Classification Search
CPC .... A47G 9/1054; A47G 9/109; A47G 9/1081; A47G 2009/1018; A47C 7/38; A47C 7/383
USPC ..... D6/601
See application file for complete search history.

(56) References Cited

U.S. PATENT DOCUMENTS 2,634,435 A * 4/1953 Leighton ..... A61H 37/00 132/333
3,315,282 A * 4/1967 Lowery ..... A47G 9/1054 5/638
3,694,831 A * 10/1972 Treace ..... A47G 9/10 5/638
D250,985 S 2/1979 Armstrong
D271,834 S * 12/1983 Huntsinger ..... 5/637
D318,203 S 7/1991 Zaghini
6,182,313 B1 2/2001 Eschenbach
6,412,127 B1 7/2002 Cuddy
6,446,288 B1 * 9/2002 Pi ..... A61G 7/072 5/636
6,471,726 B2 10/2002 Wang
6,622,325 B1 9/2003 Garza
6,922,860 B2 8/2005 Cuddy
6,931,682 B2 8/2005 Kruger, Jr.
6,993,800 B2 2/2006 Greenawalt et al.
7,017,213 B2 3/2006 Chisari
7,032,264 B2 4/2006 Funatogawa
7,063,085 B2 * 6/2006 Silva ..... A61M 16/06 128/202.18
7,165,279 B1 1/2007 Georgescu
7,434,281 B1 10/2008 Holliday et al.
8,726,436 B2 5/2014 Wright
D718,074 S * 11/2014 Savolainen ..... D6/601
8,893,331 B2 11/2014 Cupo
9,060,626 B2 6/2015 Berg
9,155,409 B2 10/2015 Cohen
9,247,837 B1 2/2016 Blake
9,414,698 B2 8/2016 Sheeler-Johnson
(Continued)

FOREIGN PATENT DOCUMENTS

EP 0880925 A1 * 12/1998 ..... A47G 9/109

*Primary Examiner* — Robert G Santos
*Assistant Examiner* — Alison N Labarge

(57) ABSTRACT

A trapezoidal-shaped foam pillow with a hole in the center and two sloping sides each sloping downward that allow the user to sleep comfortably on every side; front, back, left side and right side. The hole in the center suspends wrinkles and provides a head cradle that along with the neck rest provide therapeutic neck support while the sloping sides suspend wrinkles, reduce snoring and minimize clenched jaw.

1 Claim, 2 Drawing Sheets

(56) References Cited

U.S. PATENT DOCUMENTS

| | | | | |
|---|---|---|---|---|
| 9,730,536 | B2 | 8/2017 | Hall | |
| D859,033 | S * | 9/2019 | Stewart | D6/601 |
| 2010/0237677 | A1* | 9/2010 | Nam | A47C 7/38 297/410 |
| 2018/0042409 | A1* | 2/2018 | Johnson | A47G 9/1054 |

* cited by examiner

ANTI-WRINKLE/ANTI-SNORING/THERAPEUTIC FOAM PILLOW

RELATED U.S. APPLICATION DATA

Provisional application No. 62/487,609, filed on Apr. 20, 2017

Current U.S. Class: 1/1

Current CPC Class: A47G 9/10 (20130101); A47G 9/1081 (20130101); A47G 9/109 (20130101); A47G 9/1054 (20130101); A47G 2009/1018 (20130101)

Current International Class: A47G 9/10 (20060101)

BACKGROUND

The anti-wrinkle/anti-snoring/therapeutic foam pillow allows the user to sleep comfortably while smoothing out or protecting facial skin to suspend fine lines and wrinkles, reduce snoring and prevent clenched jaw. This is achieved by using the specially designed pillow along with the help of gravity.

SUMMARY

The market is flooded with all sorts of anti-ageing/anti-snoring/therapeutic products, and in my experience, all with disappointing results. This led me to invent a simple pillow that uses the rhythmic nightly sleep cycle with the power of gravity to obtain the desired result.

DRAWING REFERENCE NUMBERS

Figure 1:
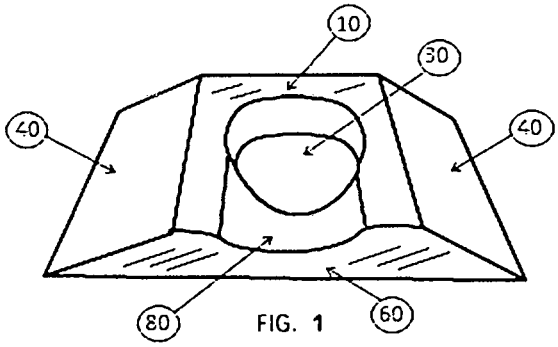
FIG. 1: is a perspective view of the upper surface, hole in the center, sloping sides, front panel and neck rest of the pillow.
Figure 2:
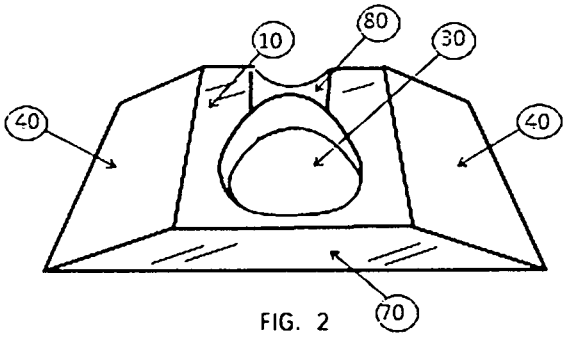
FIG. 2: is a perspective view of the upper surface, hole in the center, sloping sides, back panel and neck rest of the pillow.
Figure 3:
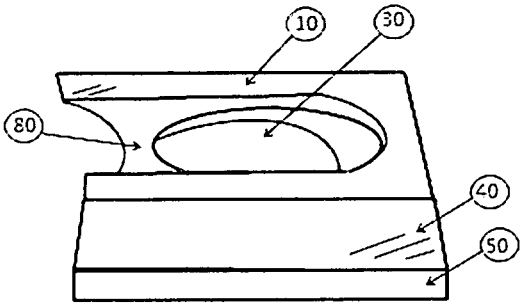
FIG. 3: is a perspective side view of the upper surface, hole in the center, sloping side, vertical side panel and neck rest of the pillow.
Figure 4:
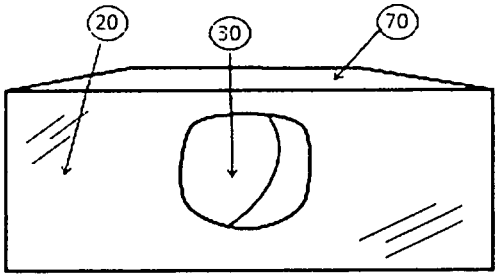
FIG. 4: is a perspective view of the lower surface, hole in the center and back panel of the pillow.

10. Upper surface
20. Lower surface
30. Hole in the center
40. Sloping side/s
50. Vertical side panel/s
60. Front panel
70. Back panel
80. Neck rest

DETAILED DESCRIPTION

The anti-wrinkle/anti-snoring/therapeutic foam pillow accommodates sleep in a more comfortable way for each type of sleep position (prone, supine and side). It does this by utilizing its unique design of a hole in the center 30 and sloping sides 40.

The hole in the center 30 permeates the pillow from the upper surface 10 to the lower surface 20 and permits the face to rest gently facing downward for the prone sleeper, upward for the back sleeper and on one's side.

The hole in the center 30 permits the user to sleep on their front without having to turn the neck to the side causing neck pain. Sleeping on one's front in this way also smooths out fine lines and wrinkles by gripping the entire perimeter of the face and causing the skin to gently pull outward.

The hole in the center 30 creates a head cradle that does not permit the user's head to waver off to one side or the other while sleeping on their back and allows for a manner of sleeping in which facial skin does not come in contact with the pillow thus reducing any nocturnally caused friction causing facial creases.

The hole in the center 30 is of ample size to accommodate long hair when pulled back allowing the user to sleep more comfortably on their back while keeping the hair away from tangling surfaces.

This hole in the center 30 accommodates the user's ear when side sleeping on the upper surface 10 permitting the user to sleep more comfortably.

The sloping sides 40 accommodate for sleeping on one's side while smoothing out the skin around the forehead, eyes, nose, cheeks, jaw and mouth. With the side of the face positioned near the top of a sloping side 40, gravity gently pulls the face downward toward the vertical side panel 50 while the skin remains in the same position so that the skin is pulled taut.

Using the sloping sides 40 also helps breathing and reduces snoring by spreading the nasal cavities on that side.

Using the sloping sides 40 can also reduce clenched jaw by putting pressure on the joint so that it cannot tighten and permit teeth grinding and temporomandibular disorder (TMD).

The neck rest 80 is a curved recess that along with the hole in the center 30 keeps the head in place, neck supported and spine aligned when in the supine position. It does this by gently keeping the face facing upwards so that one's neck does not turn to the side causing neck pain.

The invention claimed is:

1. A pillow comprising a body shaped like a trapezoid of predetermined size of predetermined dimensions, said body, made of a predetermined foam material, said body, having an upper surface and a lower surface of predetermined dimensions, said body, having a front and back panel of predetermined dimensions, connecting the upper surface to the lower surface, said body, having a hole in the center at a predetermined size of predetermined dimensions and diameter that connects the upper surface to the lower surface, configured to create a head cradle which permits a user to sleep on their front, back, and side, said body, having the hole in the center, configured to create a head cradle which permits the user to sleep on their front, further configured to smooth out the skin around the forehead, eyes, cheeks, mouth and chin, reducing fine lines and wrinkles by gripping the entire perimeter of the face and causing the skin to gently pull outward, said body, having the hole in the center, configured to create the head cradle which permits the user to sleep on their front, further configured to not having the user's neck turn to the side causing neck pain, said body, having the hole in the center, configured to create the head cradle which permits the user to sleep on their back, further configured to not allow the user's head to waver off to one side or the other causing neck pain, said body, having the hole in the center, configured to create the head cradle which permits the user to sleep on their back, further configured to not permit the facial skin to come in contact with the pillow thus reducing any nocturnally caused friction causing facial creases, said body, having the hole in the center, configured to create the head cradle which permits the user to sleep on their back, further configured to be of ample size to accommodate the smoothing of hair by keeping it tucked away in the hole in the center and away from tangling outer pillow surfaces, said body, having the hole in the center, configured to create the head cradle that allows the user to sleep on their side, further configured to accommodate the user's ear reducing the chance of a sore ear, said body, having the hole in the center, configured to create the head cradle that allows the user to sleep on their side, further configured to accommodate the comfort of the user's side of face by providing a flat upper surface surrounding the hole in the center, said body, having two sloping sides each sloping downward from the upper surface at a predetermined distance from the hole in the center; each cut at equal and predetermined slopes of a predetermined angle, said body, having the two sloping sides each sloping downward from the upper surface at a predetermined distance from the hole in the center; each cut as a smooth, flat, downward sloping surface for the entire area of each sloping side from the front panel to the back panel, said body, having the two sloping sides, configured to accommodate the entire side of the user's face near the top of one of the two sloping sides, and further configured to gently pull the face downward under gravity causing the user's skin to remain in the same position so that the skin is pulled taut, in order to smooth out the user's skin around the forehead, eyes, nose, cheeks, mouth, jaw, and chin, and reduce fine lines and wrinkles, said body, having the two sloping sides, configured to accommodate the user's face to be positioned near the top of one of the two sloping sides, and further configured to gently pull the user's face downward under gravity causing the nasal cavity on the same side of the user's face to spread in order to help breathing and reduce snoring, said body, having the two sloping sides, configured to position the user's face near the top of one of the two sloping sides, and further configured to gently pull the user's face downward under gravity causing slight pressure on the user's jaw joint in order to reduce teeth grinding, clenched jaw, and symptoms of temporomandibular disorder (TMD), said body, having the two vertical side panels on each side of predetermined dimensions; connecting the sloping sides to the lower surface, said body, having a curved recess which forms a neck rest cut at a predetermined size of predetermined dimensions, the neck rest being positioned from the hole in the center to the front panel.

* * * * *